US006296041B1

(12) United States Patent
Cicero

(10) Patent No.: US 6,296,041 B1
(45) Date of Patent: Oct. 2, 2001

(54) WINDOW NET CHILD SAFETY GUARD

(76) Inventor: Ronald Patrick Cicero, 454 D Elm St., Burbank, CA (US) 91506

( * ) Notice: Subject to any disclaimer, the term of this patent is extended or adjusted under 35 U.S.C. 154(b) by 0 days.

(21) Appl. No.: 09/652,732

(22) Filed: Aug. 31, 2000

(51) Int. Cl.[7] ..... E06B 3/68
(52) U.S. Cl. ..... 160/327; 160/368.1; 49/50
(58) Field of Search ..... 160/368.1, 327, 160/354, 351; 49/50, 57, 55, 61

(56) References Cited

U.S. PATENT DOCUMENTS

| | | | | |
|---|---|---|---|---|
| 1,325,227 | * | 12/1919 | Blankennagel | 160/327 |
| 2,094,299 | * | 9/1937 | McQuarrie | 160/327 |
| 2,459,884 | * | 1/1949 | Kopf | 49/57 |
| 2,622,285 | * | 12/1952 | Roos | 160/368.1 |
| 2,840,158 | * | 6/1958 | Lee | 160/327 |
| 4,272,922 | | 6/1981 | Prager . | |
| 4,437,265 | | 3/1984 | Turro et al. . | |
| 4,787,174 | | 11/1988 | Brown . | |
| 4,837,974 | | 6/1989 | Jokel . | |
| 4,884,614 | | 12/1989 | Spurling . | |
| 5,054,837 | * | 10/1991 | Chapman | 160/351 X |
| 5,060,421 | | 10/1991 | Castelli . | |
| 5,070,647 | | 12/1991 | Spialter . | |
| 5,207,260 | * | 5/1993 | Commesso | 160/351 X |
| 5,339,567 | | 8/1994 | Pierpont et al. . | |
| 5,454,415 | | 10/1995 | Bolling et al. . | |
| 5,531,258 | * | 7/1996 | Poulson et al. | 49/57 X |
| 5,570,543 | | 11/1996 | Bishop . | |
| 5,620,036 | | 4/1997 | Grous . | |
| 5,628,355 | | 5/1997 | Gist . | |
| 5,787,955 | * | 8/1998 | Dargie | 160/368.1 |
| 5,797,218 | * | 8/1998 | Holland | 49/57 X |
| 5,916,074 | | 6/1999 | Tracy . | |
| 6,044,892 | * | 4/2000 | Epstein | 49/57 X |

OTHER PUBLICATIONS

New York City Dept. of Health Bureau of Window Falls Revention Web Site URL: http://www.ci.nyc.ny.us/html/doh/win/winbroc.html Original Date of Download: Sunday, Jul. 09, 2000.

Vicki Lansky *Child Proof Your Home* Feb., 1991, pp. 44–45 Safety First, Chestnut Hill, MA and Book Peddlers of Deephaven, MN.

* cited by examiner

*Primary Examiner*—David M. Purol

(57) ABSTRACT

A window guard for preventing children, house pets or objects from inadvertently passing through an open window comprising, in combination, an upper nesting tube subassembly (40U) and a lower nesting tube subassembly (40L); a retaining net (52) coupled between the subassemblies; flange (20U), flange (20L), flange (32U), and flange (32L); and hitch pin (30A), hitch pin (30B), hitch pin (30C), and hitch pin (30D) used to secure the subassemblies to the flanges. The elongated subassemblies are offset from each other, then extended across the window opening. Metal screws are employed to secure the flanges, and thus the entire window net (18), to a window frame; thereby creating an extended configuration for shielding an open window. The window net is adaptable to a variety of window frame sizes or constructions, while providing complete coverage across the entire width of the window opening. Furthermore, the window net can be removed quickly and easily in an emergency situation, while maintaining the net's integrity as a window barrier.

1 Claim, 14 Drawing Sheets

WINDOW NET CHILD SAFETY GUARD

CROSS-REFERENCE TO RELATED APPLICATIONS

Figure 1:
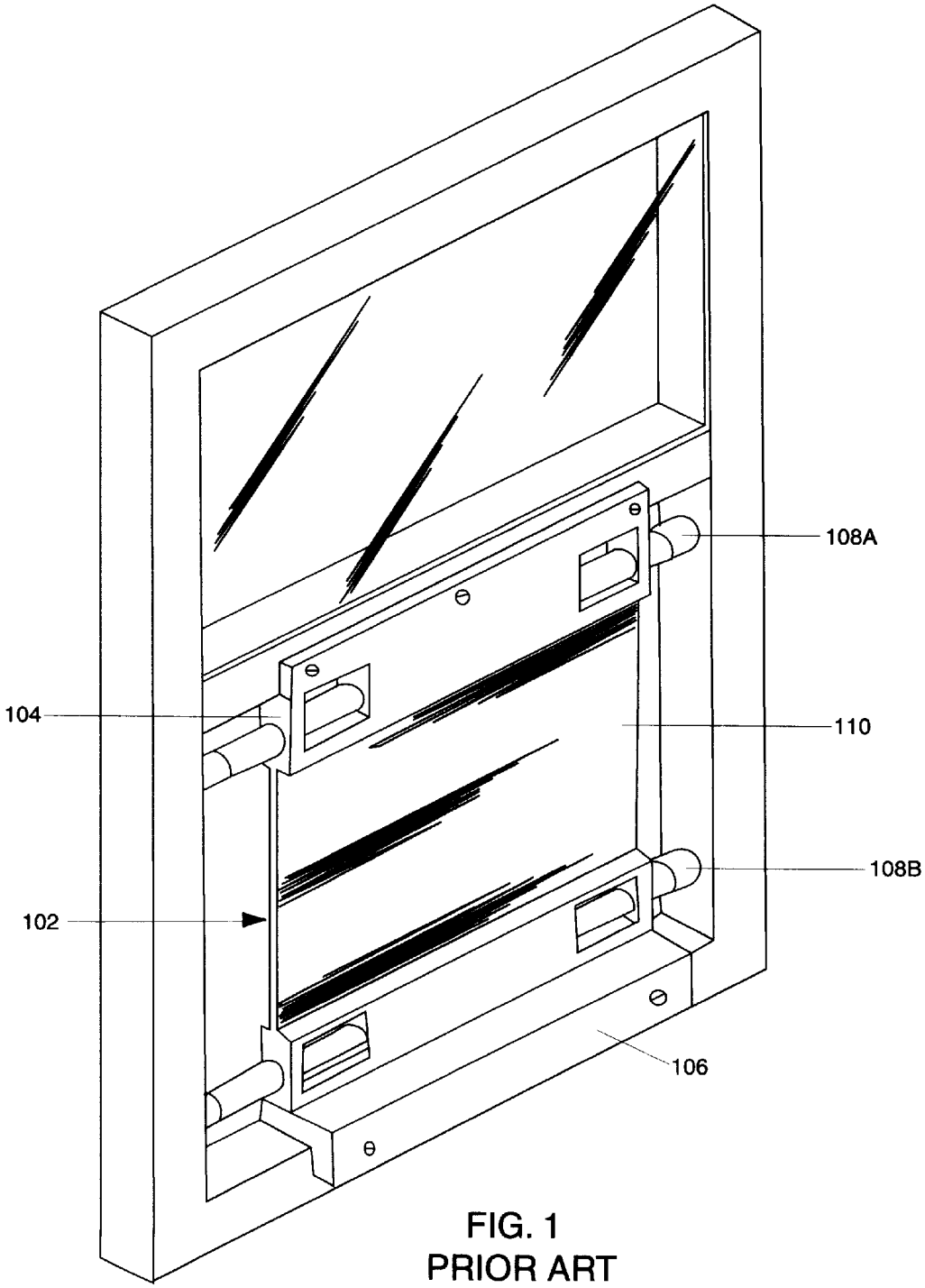
FIG. 1 PRIOR ART

Not Applicable.

BACKGROUND—FIELD OF THE INVENTION

The invention relates to window guards, specifically adjustable barriers for preventing children, pets or objects from inadvertently passing through an open window.

BACKGROUND—DESCRIPTION OF THE PRIOR ART

During the warmer months of spring and summer, a parent of a small child is often reluctant to open the windows of an apartment or house for fear the child will fall out, or throw objects outside. Although several attempts have been made to resolve this concern, a window guard which is mechanically efficient, simple to install, and capable of being removed quickly in an emergency, has yet to be designed. Furthermore, a window guard which can be effectively installed in a wide variety of window frames, irrespective of style or design, has yet to surface.

In the past, inventors have designed a multitude of window guards to prevent intrusion. Examples include U.S. Pat. No. 4,837,974 to Jokel, U.S. Pat. No. 5,070,647 to Spialter, and U.S. Pat. No. 5,339,567 to Pierpont et al. While the prior art may inhibit trespassing through a window opening from the outside, it was not intended or designed to protect children, pets or objects from falling out.

Inventors have also created adjustable barriers for preventing children from falling down stairs or entering a restricted space. Examples include U.S. Pat. No. 4,787,174 to Brown, U.S. Pat. No. 5,060,421 to Castelli and U.S. Pat. No. 4,884,614 to Spurling. Unfortunately, none of the aforementioned apparatus are designed or intended to be used effectively in a window.

Thereafter, several partial attempts have been made to design a child barrier for a window opening, including U.S. Pat. No. 4,437,265 to Turro et al., U.S. Pat. No. 5,916,074 to Tracy., and U.S. Pat. No. 5,570,543 to Bishop. The prior art by both Turro et al. and Tracy consists of a framework of overlapping bars mounted within a window frame. Neither device provides a means for enclosing the area between the bars. Consequently, neither the Turro et al. nor the Tracy guard can prohibit a small object or pet from passing through the device itself. In fact, the concern exists that an opening between the bars could be created which would still allow a small child to pass through.

While the U.S. Pat. No. 5,916,074 to Bishop offers improved window coverage, the design fails to meet a greater need: the ability to remove the apparatus quickly and easily, allowing occupants or emergency personnel to pass through the window opening, in a time of emergency. One reason for this drawback is the removal of the Bishop window guard is a two handed operation. Needless to say, the use of two hands to unseat the device may not be feasible, or even possible, depending upon the occupant and the type of emergency. Secondly, the Bishop guard is designed with the locking mechanism present on only one side of the apparatus. Thus, if the device is installed with the locking mechanism on the inside, the means for removal would be inaccessible to emergency personnel trying to gain access from the outside, and vise versa.

Finally, another shortcoming of the Bishop guard is the dependency upon springs to provide enough friction to secure the device in place. If, through repeated installation and removal, the springs lose tension, or become disengaged from the locking mechanism, the results could be tragic.

An alternative design for a window guard can be found in U.S. Pat. No. 5,454,415 to Bolling, et al. As seen in FIG. 1, the Bolling reference is dependent upon a U-shaped bracket 104 and an L-shaped bracket 106 to attach the Bolling window screen 102 to a double hung window. The drawbacks of the design are threefold:

First, window units vary greatly in design. In order to utilize the Bolling, et al. apparatus, one must have a double hung window with a window sash which opens upwards in a frame. The prior art is not adaptable to alternative window styles such as French windows, which open inwards or outwards on a set of vertical hinges. Thus, the prior art of Bolling, et al. is limited or made useless by the introduction of a an alternative window design.

Second, window frames are manufactured in a multitude of sizes. Although the Bolling, et al. reference claims it is adjustable, the correct installation of the L-shaped bracket is dependent upon a window frame having certain predetermined dimensions. For example, the sill must have a slope and depth which will allow the bracket 106 to fit as intended. While the prior art may be adjustable in width, specific elements necessary for its correct installation are limited in their adaptability; thus limiting the scope of the prior art by Bolling, et al..

Lastly, the Bolling, et al. reference shares the same shortcomings as that of both Turro et al. and Tracy. While rail bar 108A and rail bar 108B of the Bolling et al. design transverse the entire width of the window frame, the screen element 110 does not completely shield the window opening. Thus, object, pets, or even a small child can still pass through the window, via the space between the edges of the screen and the sides of the window frame.

Thus, the prior art fails to provide a means for resolving an important safety concern: the prevention of children, pets or objects from passing through a window opening or section thereof. The prior art does not illustrate a window guard which is truly adaptable to a multitude of window frame sizes and/or styles; while exhibiting a means for removing the guard quickly at a time of peril. Consequently, the need for such a window guard remains unfulfilled.

SUMMARY

The Window Net Child Safety Guard is an effective means of preventing children, objects or pets from passing through a window opening. The Window Net is mechanically efficient; able to be removed quickly and easily in an emergency; and adaptable to a wide variety of window frame sizes and styles.

OBJECTS AND ADVANTAGES

Accordingly, several objects and advantages of the Window Net Child Safety Guard are as follows:

(a.) to provide an effective means of preventing children, objects or pets from passing through a window opening or section thereof;

(b.) to provide an adjustable window guard which can be securely installed in window frames of varying sizes and styles;

(c.) to provide a window guard which can be removed rapidly and with minimal effort, by an adult, at any time;

(d.) to provide an improved window guard comprised of a minimal number of mechanical elements; thereby eliminating parts used previously which could fail, or prove difficult to install or maintain by the average person.

Further objects and advantages are to provide a window guard apparatus which does not impede airflow, or substantially affect one's view through the window opening; is constructed of a minimal amount of parts for inexpensive manufacture and ease of use; and is capable of withstanding the normal structural demands placed on a barrier by an average child, five years old or under. Still further objects and advantages will become apparent from a consideration of the ensuing description and drawings.

DRAWING FIGURES

FIG. 1: Perspective view of PRIOR ART: U.S. Pat. No. 5,454,415 to Bolling, et al.

Figure 2:
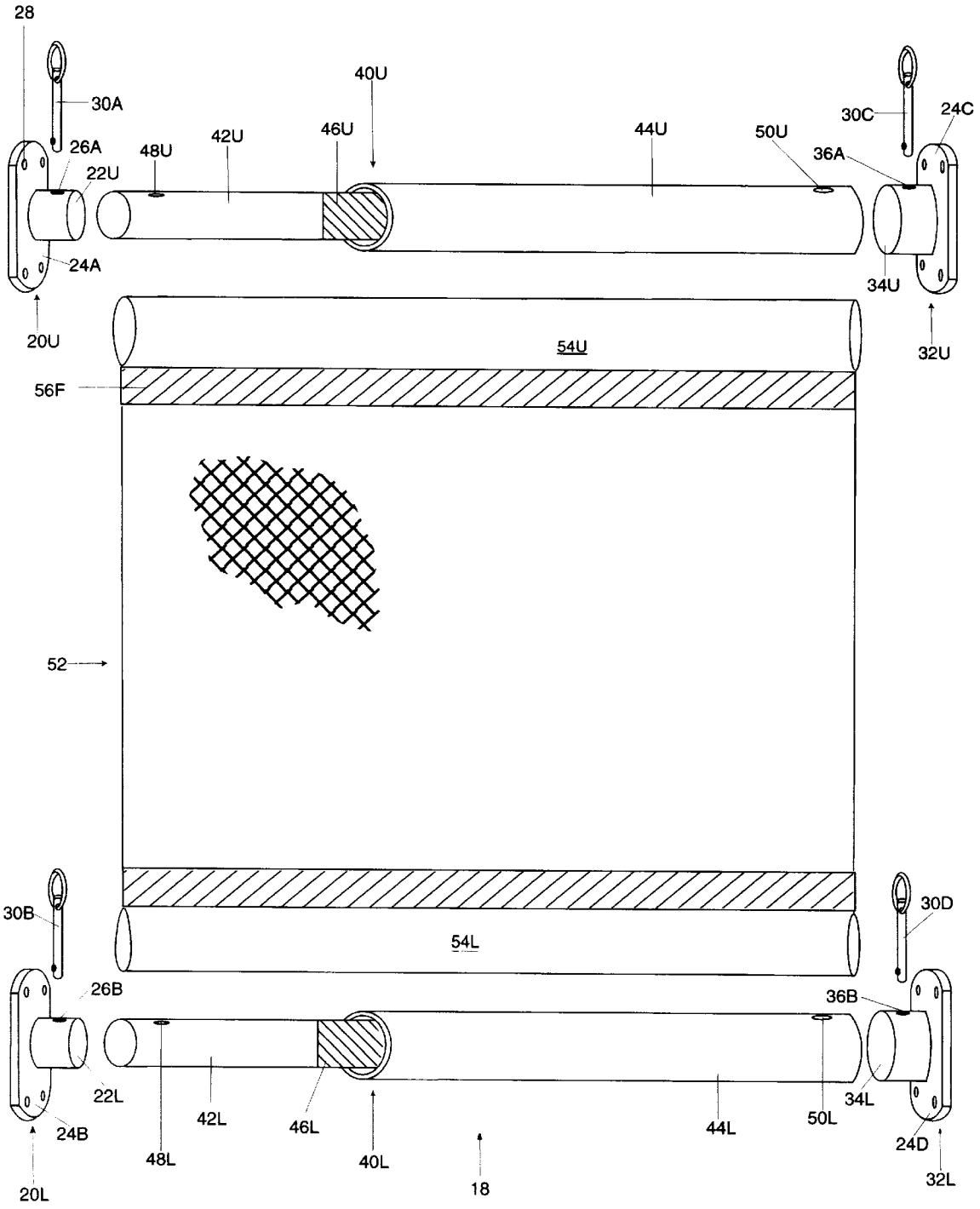

FIG. 2: An exploded view of the Preferred Embodiment.

Figure 2A:
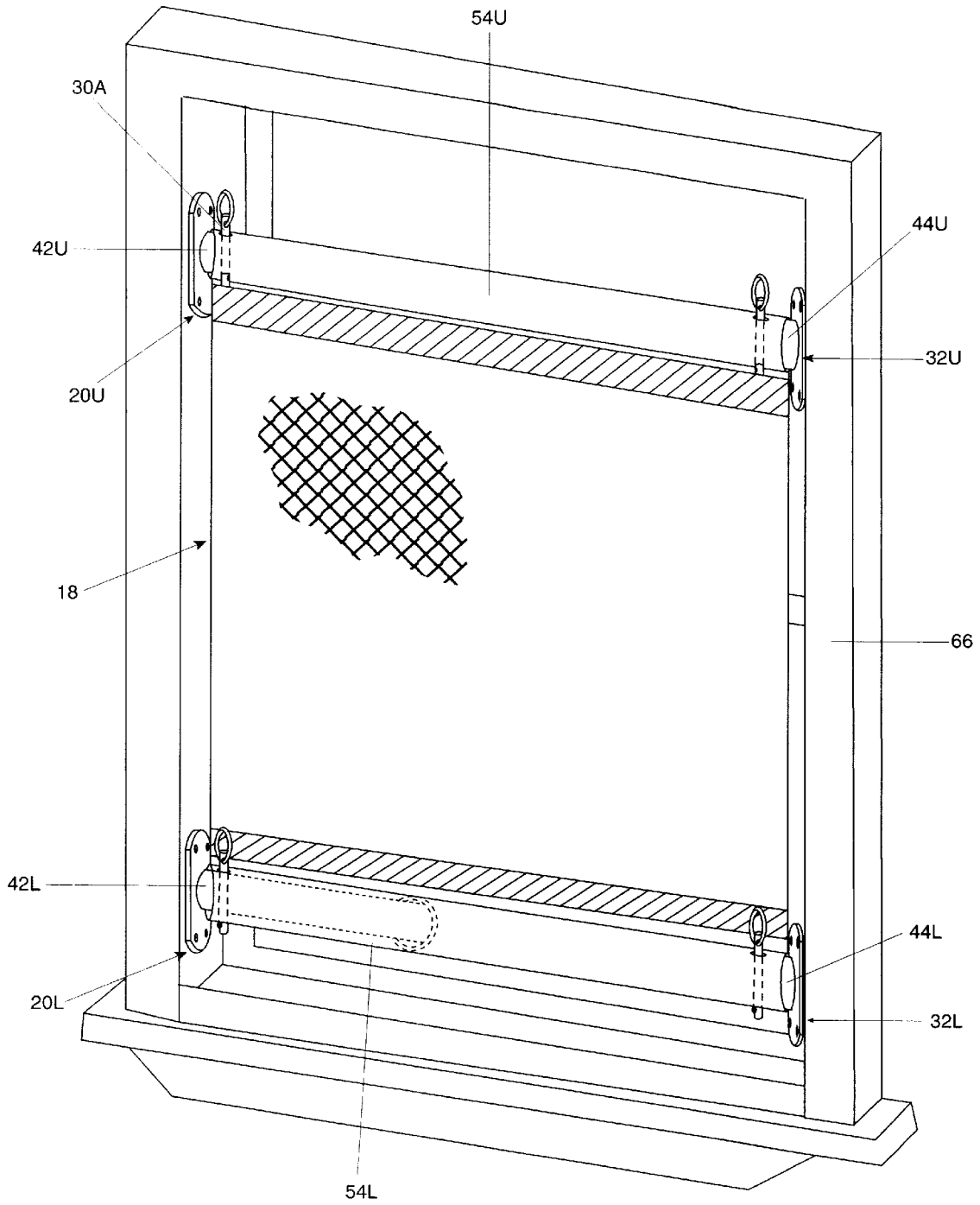

FIG. 2A: Perspective view of Preferred Embodiment installed in a double hung window.

Figure 2B:
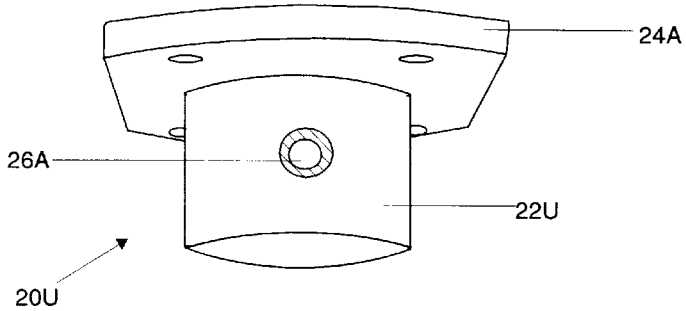

FIG. 2B: Perspective view of Minor Flange of Preferred Embodiment.

Figure 2C:
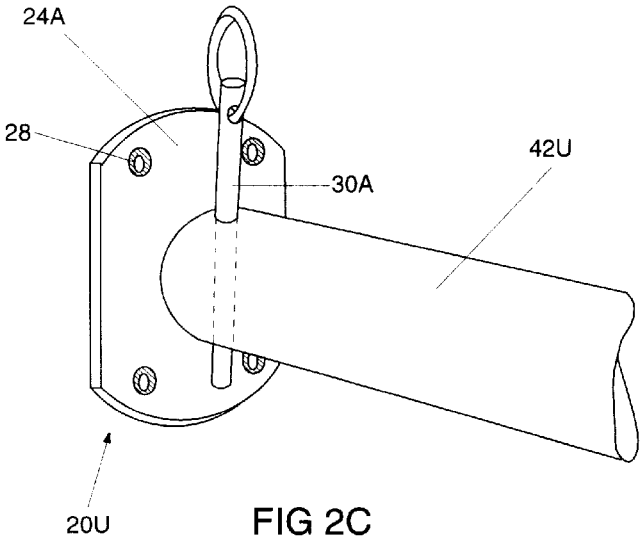

FIG. 2C: Perspective view of Minor Flange of Preferred Embodiment coupled to end of Interior Nesting Tube w/Hitch Pin as a locking means.

Figure 2D:
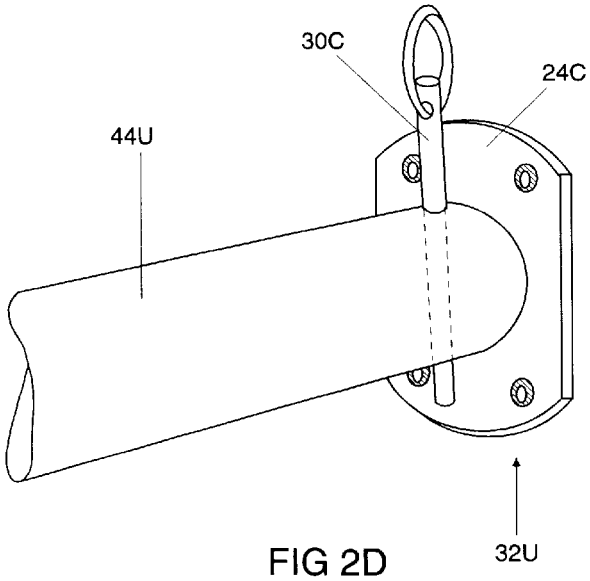

FIG. 2D: Perspective view of Major Flange of Preferred Embodiment coupled to end of Exterior Nesting Tube w/Hitch Pin as a locking means.

Figure 2E:
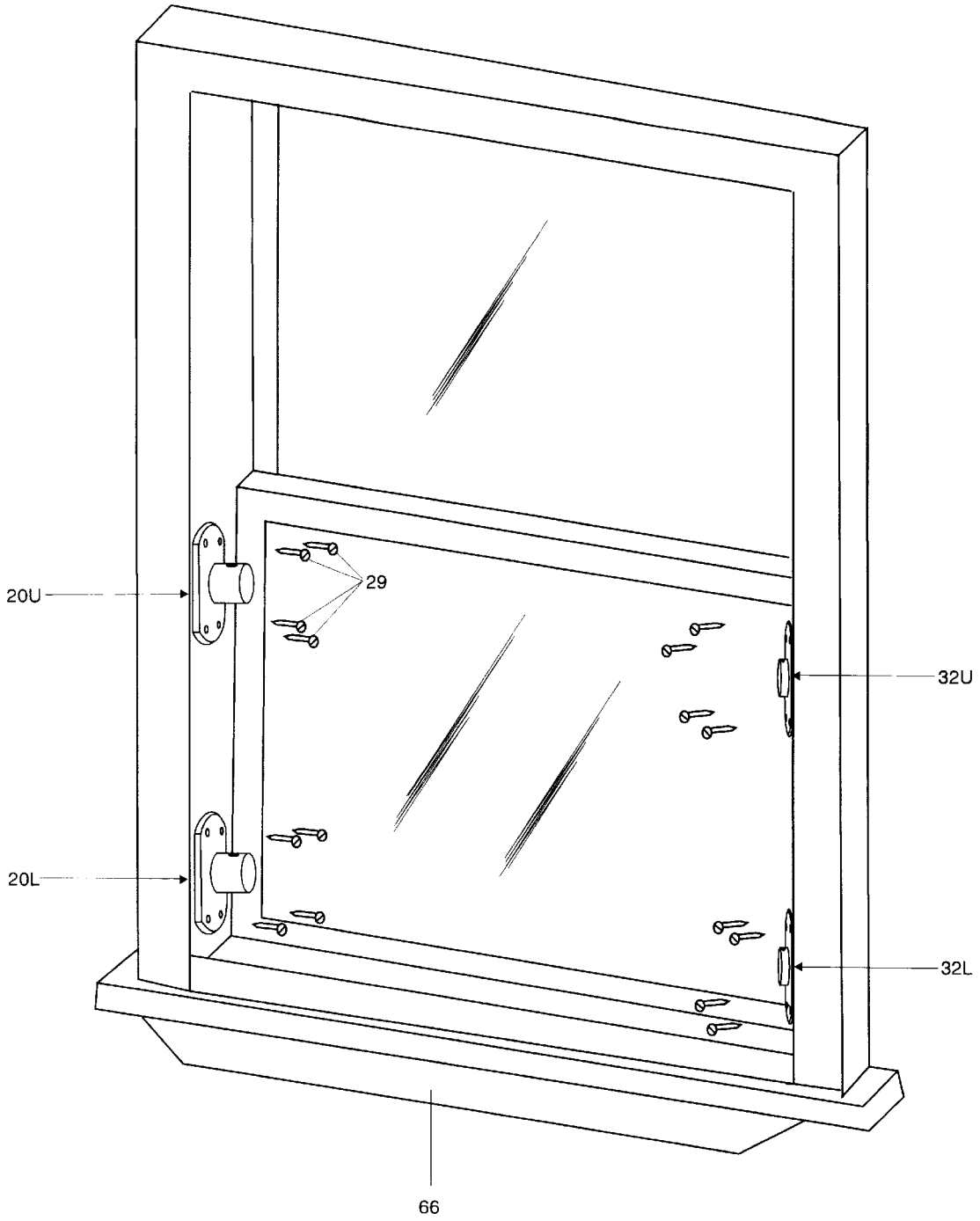

FIG. 2E: Exploded view of installation of Flanges of Preferred Embodiment into a double hung window frame.

Figure 2F:
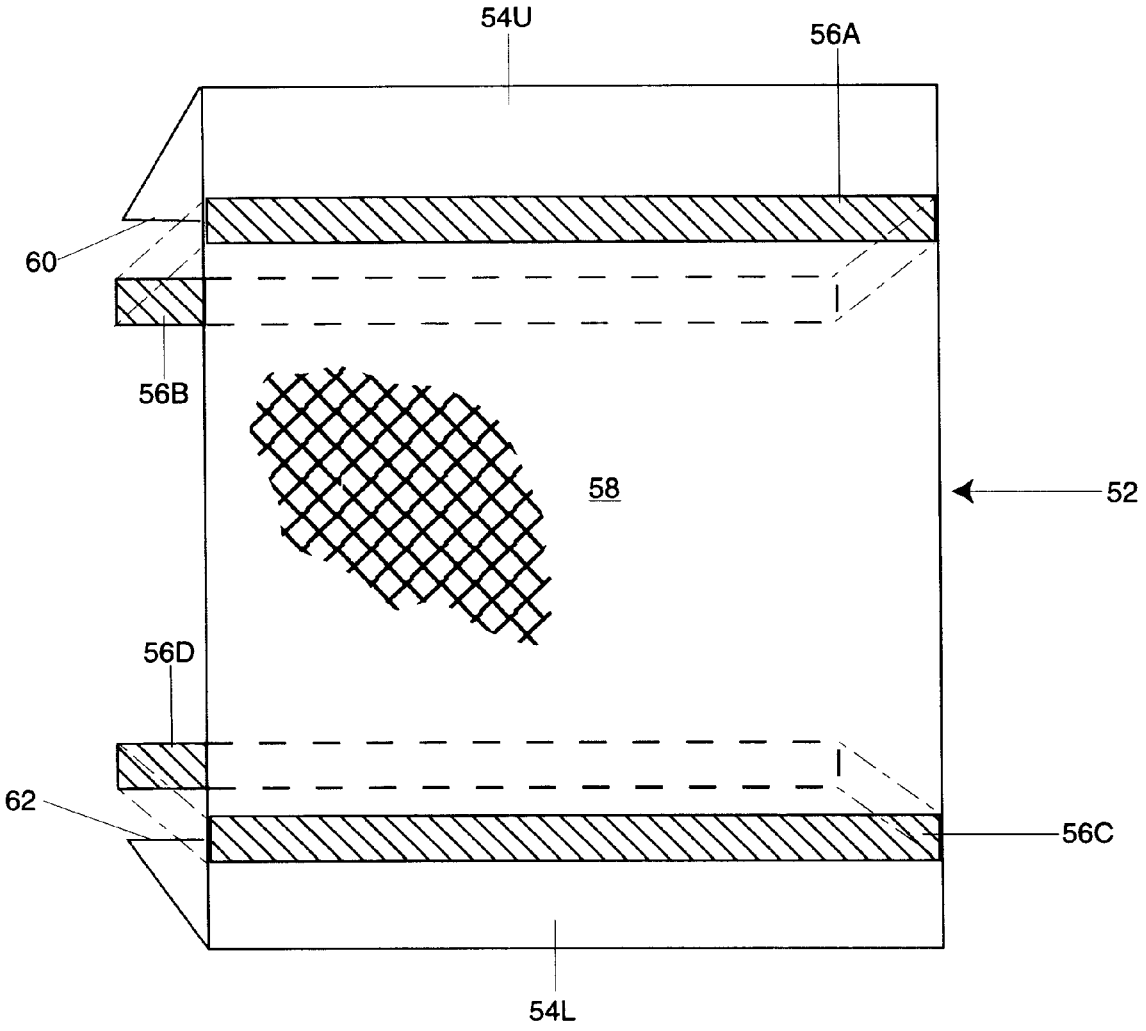

FIG. 2F: Exploded view of construction of Loops on Retaining Net of Preferred Embodiment.

Figure 2G:
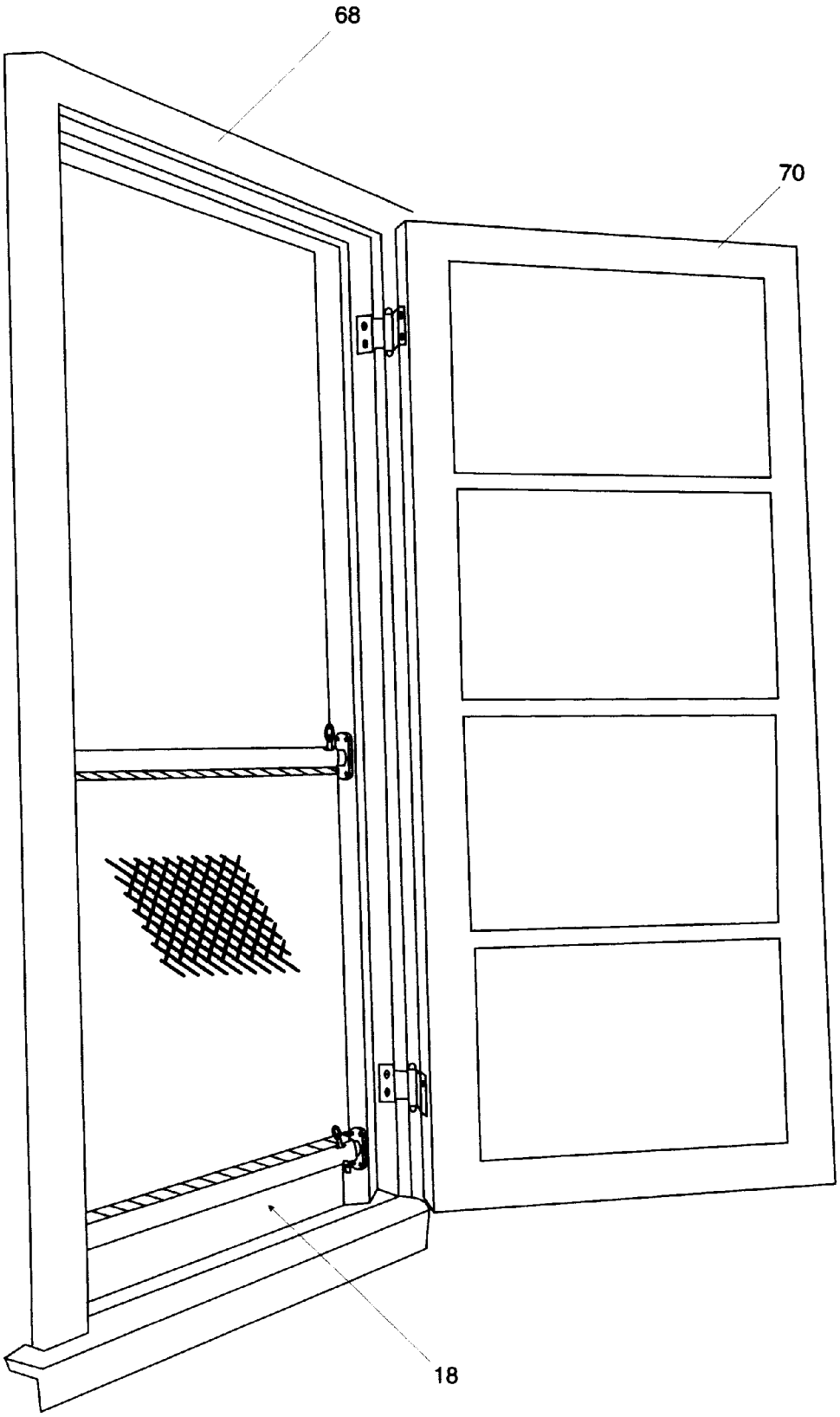

FIG. 2G: Perspective view of Preferred Embodiment installed in a French Window.

Figure 3:
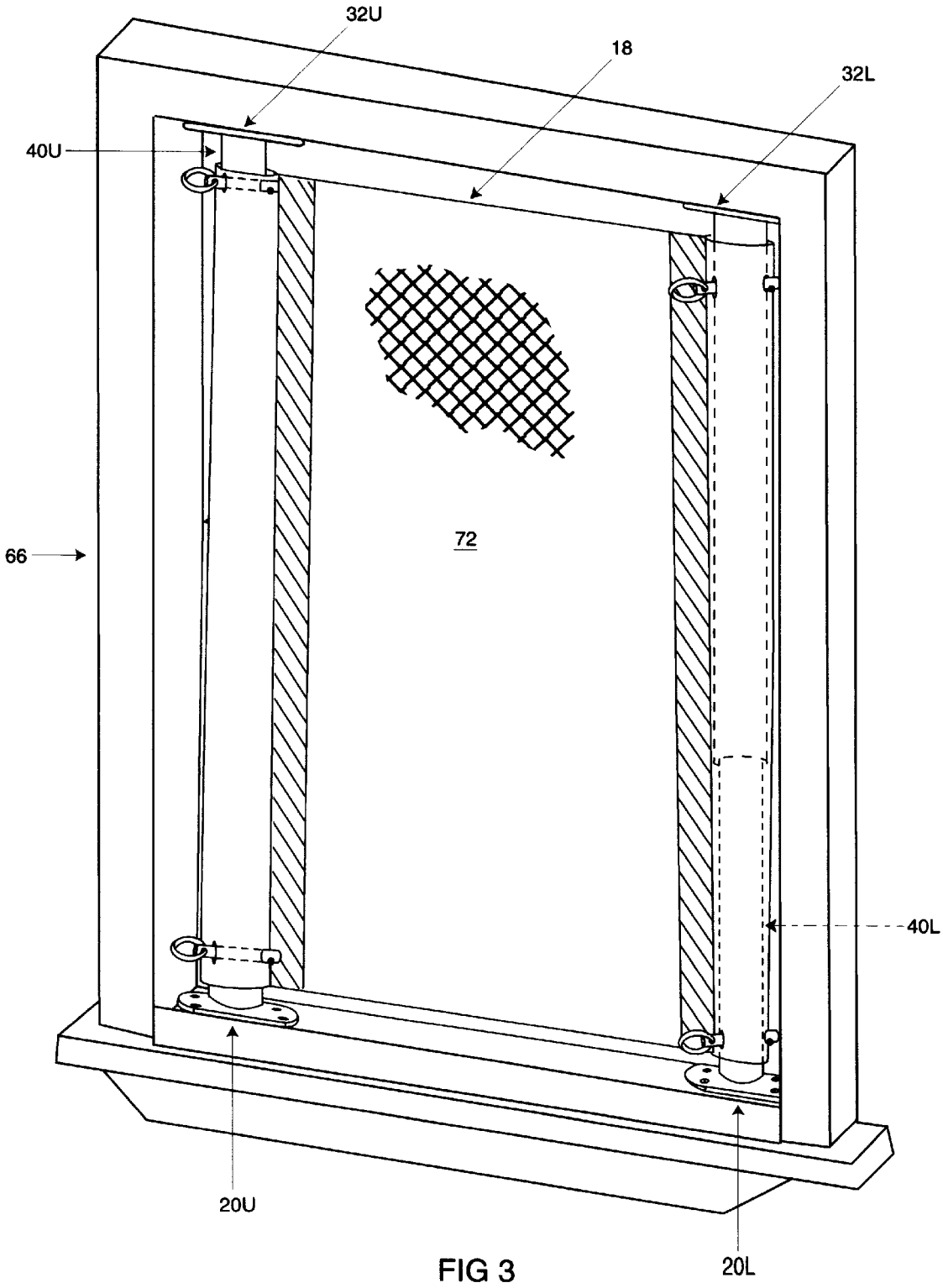

FIG. 3: Perspective view of Window Net installed vertically in a window.

Figure 4:
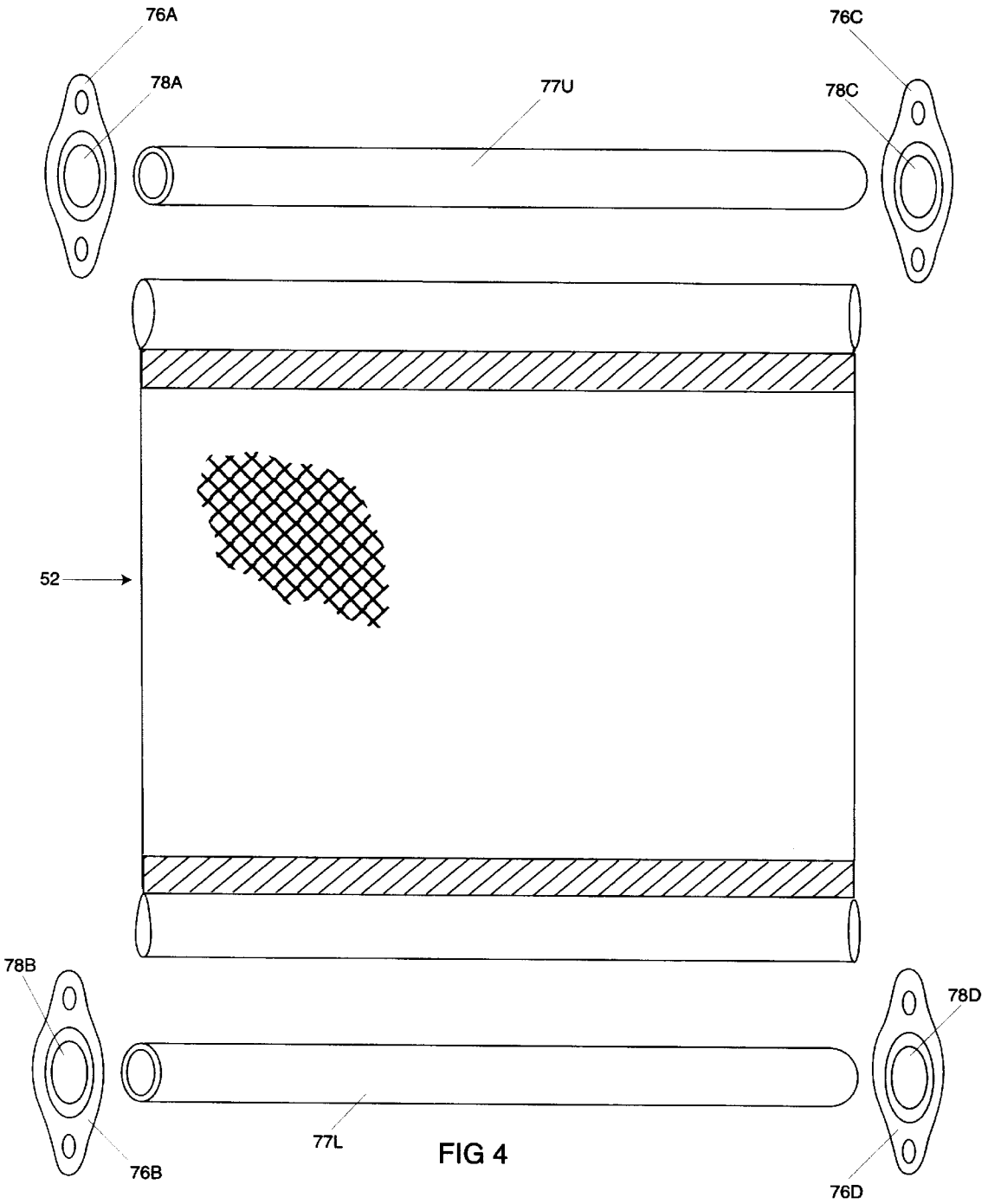

FIG. 4: Exploded view of Alternate Embodiment: Custom Window Net.

Figure 4A:
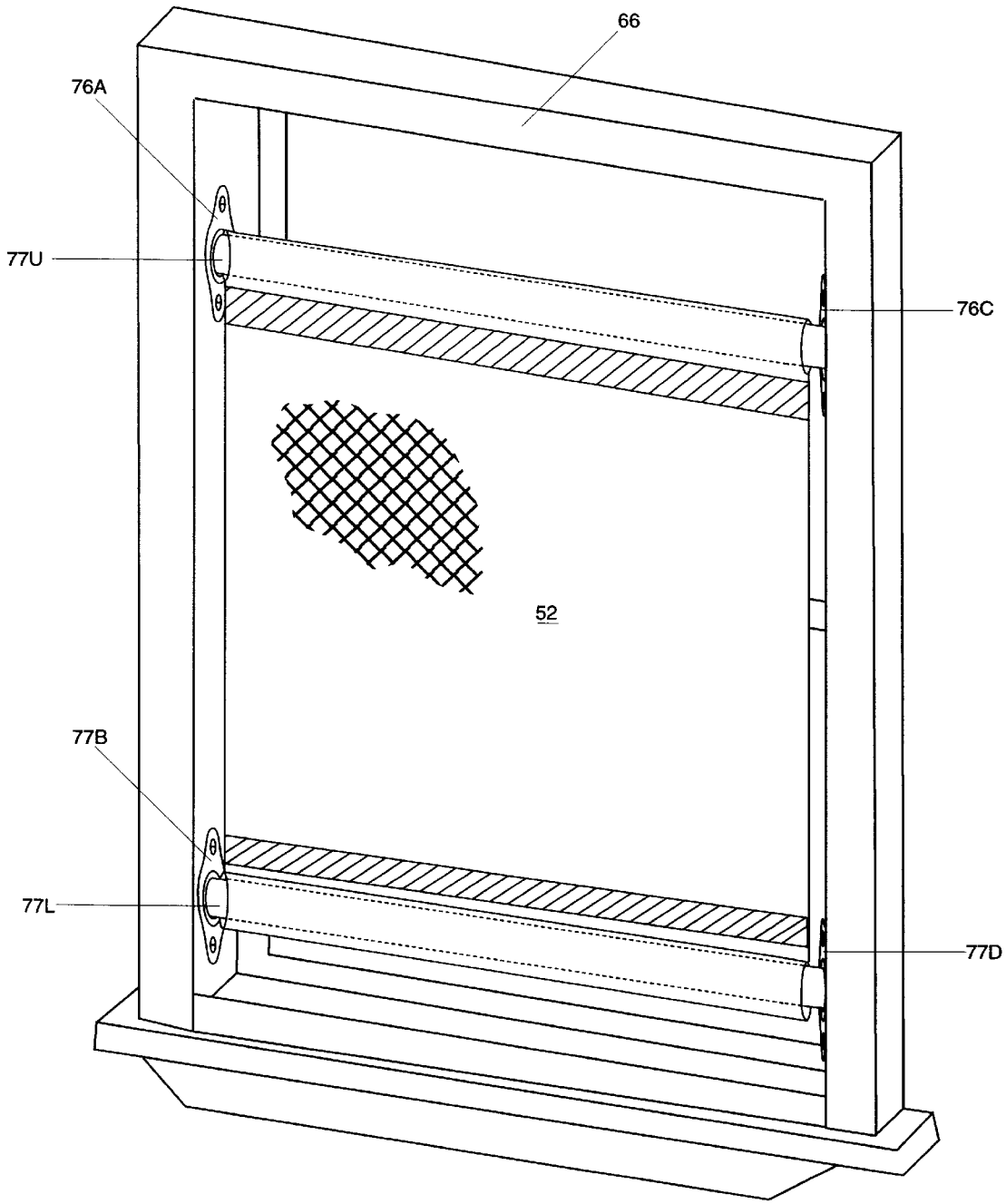

FIG. 4A: Perspective view of Custom Net installed in a window.

Figure 5:
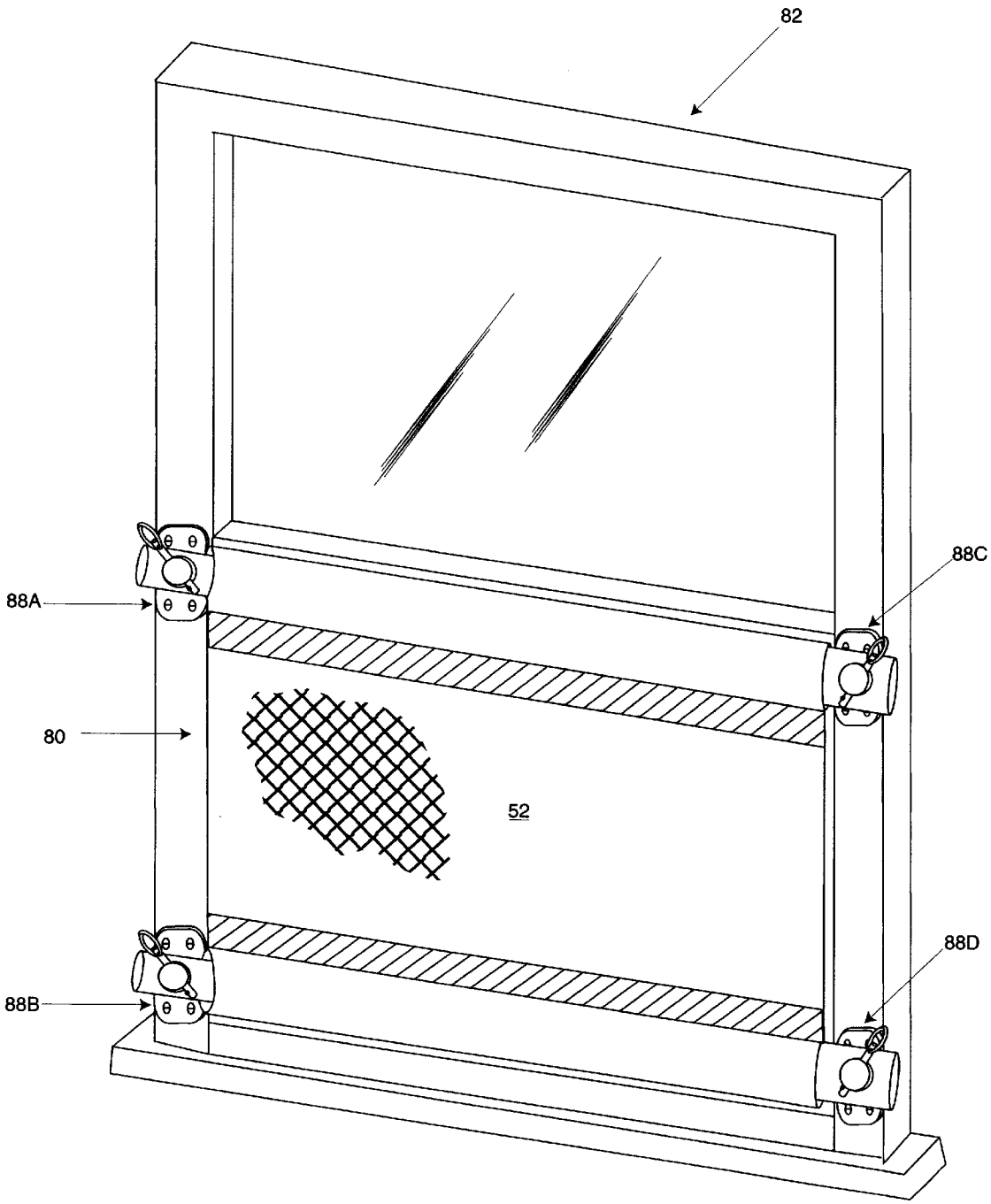

FIG. 5: Perspective view of Wall Mounted Window Net installed over window.

Figure 5A:
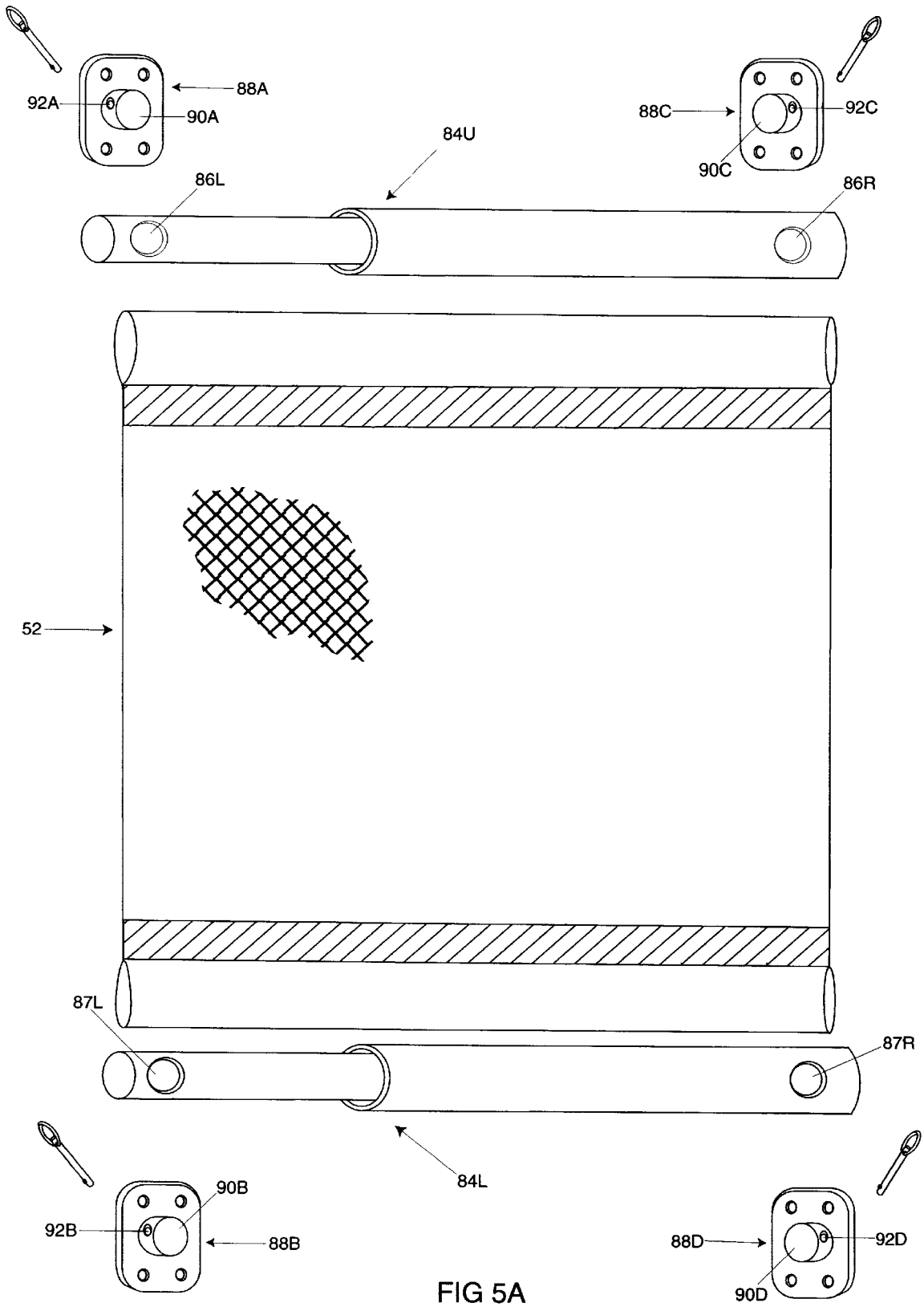

FIG. 5A: Exploded view of Alternate Embodiment: Wall Mounted Window Net.

Figure 6:
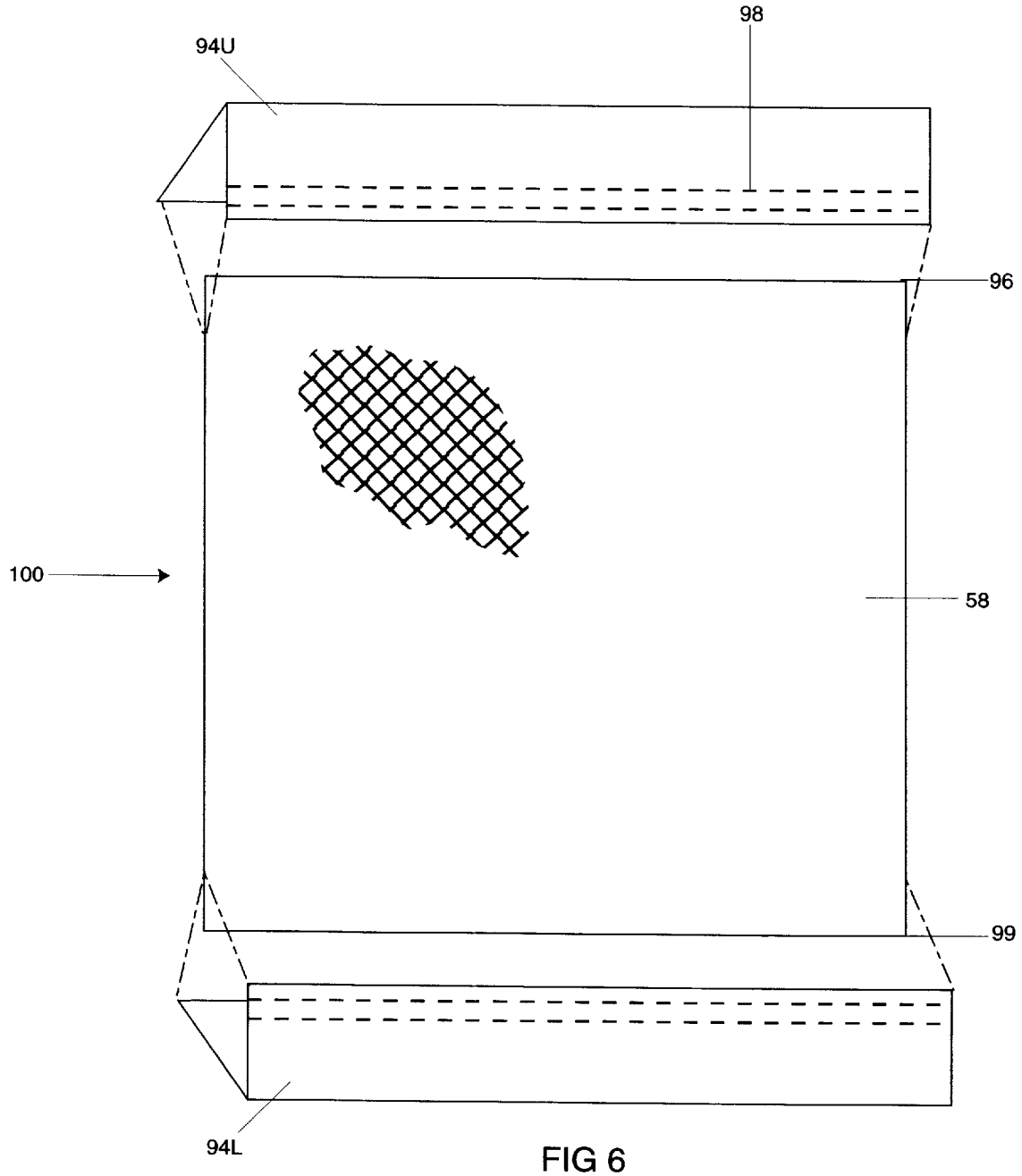

FIG. 6: Exploded view of construction of Alternate Retaining Net.

Figure 6A:
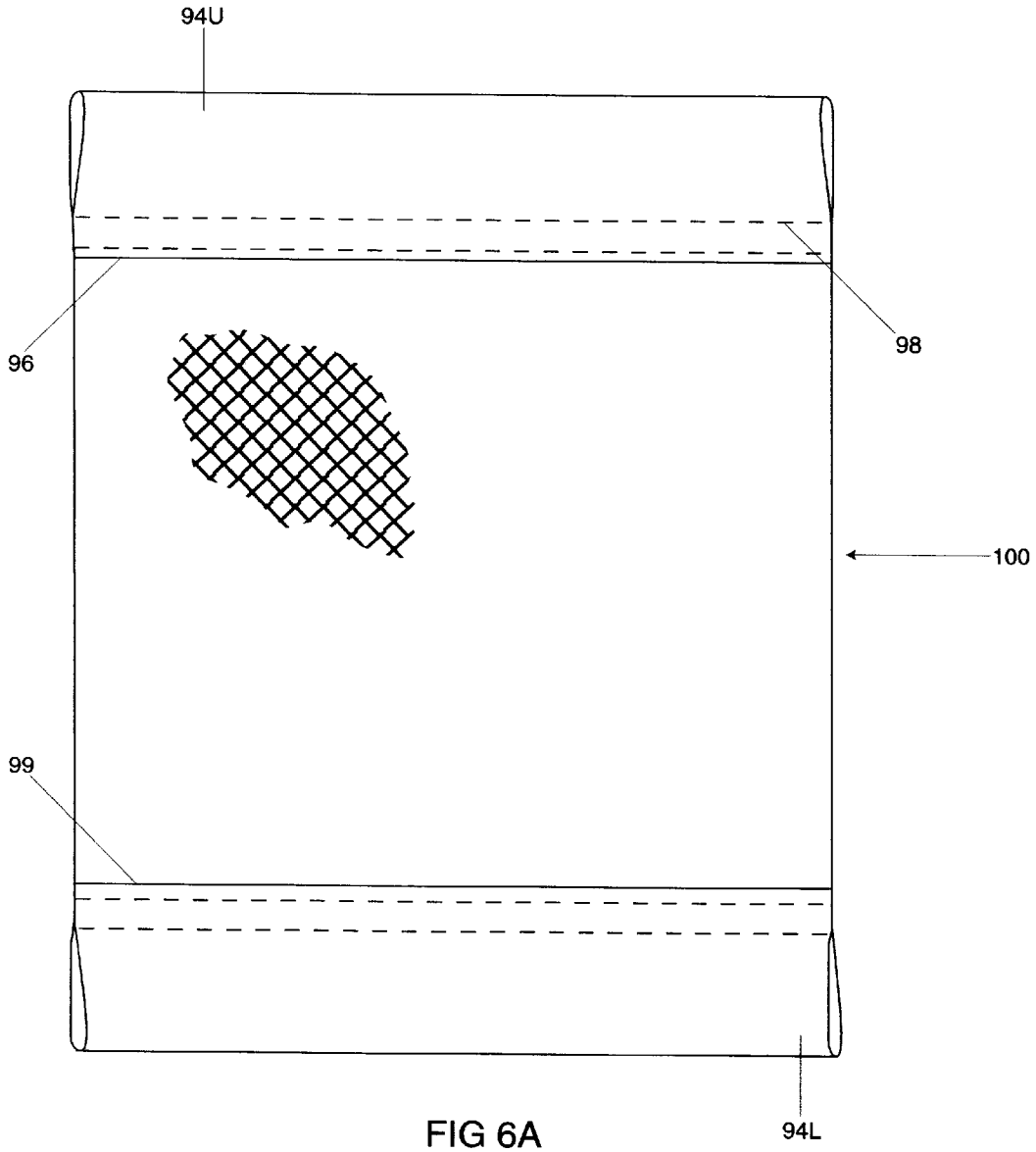

FIG. 6A: Perspective view of Alternate Retaining Net completed.

REFERENCE NUMBERS IN DRAWINGS

18. Child Safety Window Net
20U. Upper Minor Flange
20L. Lower Minor Flange
22U. Upper Minor Flange Knob
22L. Lower Minor Flange Knob
24A. Backplate for Upper Minor Flange
24B. Backplate for Lower Minor Flange
24C. Backplate for Upper Major Flange
24D. Backplate for Lower Major Flange
26A. Upper Minor Flange Knob Aperture
26B. Lower Minor Flange Knob Aperture
28. Screw hole
29. Screw set
30A. Hitch pin, upper left
30B. Hitch pin, lower left
30C. Hitch pin, upper right
30D. Hitch pin, lower right
32U. Major Flange—Upper
32L. Major Flange—Lower
34U. Major Flange Knob—Upper
34L. Major Flange Knob—Lower
36A. Upper Major Flange Knob Aperture
36B. Lower Major Flange Knob Aperture
40U. Upper Nesting Tube subassembly
40L. Lower Nesting Tube subassembly
42U. Upper Interior Nesting Tube
42L. Lower Interior Nesting Tube
44U. Upper Exterior Nesting Tube
44L. Lower Exterior Nesting Tube
46U. Safety Indicator for Upper Tube
46L. Safety Indicator for Lower Tube
48U. Upper Interior Nesting Tube Hole
48L. Lower Interior Nesting Tube Hole
50U. Upper Exterior Nesting Tube Hole
50L. Lower Exterior Nesting Tube Hole
52. Retaining Net
54U. Upper Loop
54L. Lower Loop
56A. Front Upper Webbing Strip
56B. Upper Rear Webbing Strip
56C. Lower Front Webbing Strip
56D. Lower Rear Webbing Strip
58. Net Material
60. Top Edge of Net
62. Lower Edge of Net
66. Window Frame
68. French Window Frame
70. French Window
72. Retaining Net for Vertical Window Net
74. Custom Window Net
76A. Floor Flange Upper Left
76B. Floor Flange Lower Left
76C. Floor Flange Upper Right
76D. Floor Flange Lower Right
77U. Upper Pipe for Custom Window Net
77L. Lower Pipe for Custom Window Net
78A. Flange Aperture for 76A
78B. Flange Aperture for 76B
78C. Flange Aperture for 76C
78D. Flange Aperture for 76D
80. Alternate Window Net
82. Narrow Window Frame
84U. Upper Alternate Nesting Tube Subassembly
84L. Lower Alternate Nesting Tube Subassembly
86R. Aperture on Upper Alternate Subassembly; Right side
86L. Aperture on Upper Alternate Subassembly; Left side
87R. Aperture on Lower Alternate Subassembly; Right side
87L. Aperture on Lower Alternate Subassembly; Left side
88A. Alternate Upper Left Flange
88B. Alternate Lower Left Flange
88C. Alternate Upper Right Flange
88D. Alternate Lower Right Flange
90A. Alt. Knob Upper Left Flange
90B. Alt. Knob Lower Left Flange
90C. Alt. Knob Upper Right Flange
90D. Alt. Knob Lower Right Flange
92A. Alt. Knob Upper Left Flange Aperture
92B. Alt. Knob Lower Left Flange Aperture
92C. Alt. Knob Upper Right Flange Aperture
92D. Alt. Knob Upper Right Flange Aperture
94U. Upper Alternate Loop
94L. Lower alternate Loop

96. Top Edge of Nylon Net Material
98. Straight Stitch for Closure of Alternate Loop
99. Bottom Edge of Nylon Net Material
100. Alternate Retaining Net
102. PRIOR ART: Bolling Window Screen
104. PRIOR ART: Bolling U-Shaped Bracket
106. PRIOR ART: Bolling L-Shaped Bracket
108A. PRIOR ART: Upper Rail Bar
108B. PRIOR ART: Lower Rail Bar
110. PRIOR ART: Screen

DESCRIPTION—FIGS. 2, 2A, 2B, 2C, 2D and 2E—PREFERRED EMBODIMENT

A preferred embodiment of the window net of the present invention is illustrated in the enclosed drawings; specifically in the exploded view of FIG. 2 and the perspective view of FIG. 2A. The window net consists of two identical minor flanges, labeled as an upper minor flange 20U and a lower minor flange 20L; two identical major flanges, referenced as an upper major flange 32U and a lower major flange 32L; two identical nesting tube subassemblies, labeled as an upper nesting tube subassembly 40U and a lower nesting tube subassembly 40L; four identical hitch pins, or similar connecting/locking means, labeled as hitch pin 30A, hitch pin 30B, hitch pin 30C, and hitch pin 30D; and a retaining net or screen 52. The assembled Window Net 18 is shown mounted in a double hung window frame 66 in the perspective view of FIG. 2A.

As seen in the exploded view of FIG. 2, the minor flange 20U consists of a minor flange knob 22U attached perpendicularly to a flange back plate 24A. Knob 22U is roughly 10 mm (½ inch) in length, 10 mm (½ inch) in height and equal in diameter to the interior diameter of interior nesting tube 42U. The knob has an aperture 26A vertically disposed therethrough. Aperture 26A is positioned on the knob at a distance from attached back plate 24A which is equal to the distance from a nesting tube hole 48U to the end of the interior nesting tube 42U. The aperture 26A and the hole 48U are of the same radius. FIG. 2B provides a top view of the minor flange.

As detailed in the perspective view of FIG. 2C, knob 22U is coupled within nesting tube 42U. Aperture 26A is vertically aligned with nesting tube hole 48U (FIG. 2) and hitch pin 30A is disposed therethrough. Once the hitch pin reaches a final locked position, the arrangement should be such that the average child of five years can not remove the hitch pin 30A from the aperture and/or the nesting tube hole. The friction should not be so great, however, that one of a later age could not remove the hitch pin 30A with a reasonable amount of effort.

As seen in FIG. 2, the construction of lower minor flange 20L is the same as flange 20U. The lower flange consists of a backplate 24B and a knob 22L. Furthermore, the means of attaching knob 22L to nesting tube 42L is also the same: coupling knob 22L within tube 42L and disposing hitch pin 30B through a lower interior nesting tube hole 48L and a corresponding minor flange aperture 26B.

The second primary element, the major flanges, each consist of a major flange knob 34U, or major flange knob 34L, attached perpendicularly to a flange back plate 24C, or flange back plate 24D. Both knob 34U and knob 34L are approximately 10 mm (½ inch) in length, 10 mm (½ inch in height), and equal in diameter to the interior diameter of an exterior nesting tube 44U. Knob 34U has an aperture or hole 36A vertically disposed therethrough. Likewise, knob 34L also has an aperture 36B vertically disposed therethrough.

Aperture 36A is positioned on knob 34U at a distance from the attached backplate equal to the distance from a nesting tube hole 50U to the end of exterior nesting tube 44U. Identically, Aperture 36B is positioned on knob 34L at a distance from the attached back plate equal to the distance from a nesting tube hole 50L to the end of exterior nesting tube 44L. Aperture 36A, aperture 36B, hole 50U and hole 50L are equal in diameter.

The Major flange knob apertures are of a diameter which allow the corresponding hitch pins to be coupled within to obtain a final locked position. The arrangement should be such that the average child of five years can not remove hitch pin 30C or hitch pin 30D from the corresponding aperture. The friction should not be so great, however, that one of a later age could not remove the hitch pins with a reasonable amount of effort. FIG. 2D is a perspective view detailing the coupling of hitch pin 30C, flange 32U and nesting tube 44U.

Backplate 24A, backplate 24B, backplate 24C, and backplate 24D (FIG. 2), an identical component of all four flanges, are roughly 30 mm (1½ inches) in width, 42 mm (2 inches) in length, and 3 mm (⅛ inch) in thickness. The backplates are rectangular in shape, or they may have a rounded top for a more economical means of manufacture. The backplates have a set of four screw holes 28 through which a set of screws 29 are disposed. Each screw is then coupled to a side edge of the window frame; securing the backplates in a stationary position within frame 66. FIG. 2E illustrates the process of attaching the backplates, and thus the flanges, to the window frame.

All four of the flanges are constructed of a hardened material such as steel or aluminum. The material should be resistant to corrosion.

The third major element, the nesting tube subassemblies, each consist of the aforementioned interior nesting tube 42U, or interior nesting tube 42L, slidably disposed within corresponding exterior nesting tube 44U or exterior nesting tube 44L, respectively. Tube 42U and tube 44U are position such that hole 48U and hole 50U are at opposing ends. Likewise, tube 42L and tube 44L are also position such that hole 48L and hole 50L are at opposing ends.

Interior tube 42U has a safety indicator 46U printed, painted or attached to the end of the tube opposite hole 48U. Indicator 46U should be a minimum of 105 mm (5 inches) or ⅓rd the length of interior tube 42U, which ever is greater. Identically, interior tube 42L has a safety indicator 46L printed, painted or attached to the end opposite hole 48L. Indicator 46L should also be a minimum of 105 mm (5 inches) or ⅓rd the length of interior tube 42L, which ever is greater.

The nesting tube subassemblies should be of a hardened material, such as steel or aluminum, which is resistant to corrosion and are capable of withstanding a minimum of 150 pounds of pressure before bending, breaking or otherwise failing. The outside diameter of the interior tubes is equal to the inner diameter of the exterior tubes; roughly 18 mm (⅞ths of an inch.) The exterior tubes have an exterior diameter of roughly 21 mm (1 inch.)

The fourth major element is retaining net 52, seen in the exploded view of FIG. 2. Net 52 is at least 26 inches in height and of a width equal to that of the nesting tube subassemblies, when the subassemblies are axially extended to a maximum predetermined length. Net 52 is composed of nylon, plastic or similar pliable material.

As seen in FIG. 2A, the retaining net has an upper loop 54U and a lower loop 54L. Loop 54U is of a diameter which allows tube subassembly 40U to be sidably disposed therein.

Likewise, loop 54L is of an equal diameter, allowing tube subassembly 40L to be slidably disposed therein. In FIG. 2F, loop 54U is constructed by making a fold at a top edge 60 of a net material 58 and seaming the edge to the material. The seamed edge is then sewn between a font webbing strip 56A and a rear webbing strip 56B, further strengthening the upper loop. The lower loop is created in an identical manner: a lower edge 62 is folded over and seamed; then reinforced with a front webbing strip 56C and rear webbing strip 56D.

The assembly of the preferred embodiment is as follows:

In FIG. 2A, the minor flanges are screwed to the same vertical side of the window frame, such that the distance between the center of upper flange knob 22U and the center of lower flange knob 22L is equal to the distance between the center of the upper loop and the center of the lower loop. In addition, lower flange 20L is mounted no more than three inches from the bottom of the window frame. The apertures of each of the minor flange knobs are positioned vertically, parallel to the vertical sides of the window frame.

The major flange are screwed to the window frame on the same vertical side of the window frame, opposite the minor flanges. Major flange 32L is mounted parallel to, and directly across from, minor flange 20L. Major flange 32U is attached to the window frame at a distance from major flange 32L equal to the vertical span between the minor flanges. The major flange apertures are also vertically positioned.

Once all four of the flanges have been secured to the window frame, the upper nesting tube subassembly is threaded through the upper loop and the lower nesting tube subassembly is threaded through the lower loop.

Upper nesting tube subassembly 40U is attached to the upper minor flange and the upper major flange as follows: The end of nesting tube 42U is coupled onto knob 22U until the end of the tube is flush with the attached backplate. Hole 48U and aperture 26A are then aligned vertically; creating a single, unobstructed channel for the hitch pin. The subassembly is then axially extended across the width of the window frame. The end of the exterior nesting tube 44U is installed onto knob 34U until the end of the tube is flush with the attached back plate 24C. The hole and aperture are then aligned vertically; creating a single, unobstructed channel for hitch pin 30C. The hitch pins are inserted through openings in the net material of loop 54U, then disposed within the aforementioned channels. FIG. 2A illustrates the completed process.

The method of installation outlined above is also used to attach the lower nesting tube subassembly 40L to minor flange 20L and major flange 32L, and thus, to the window frame. Once installed, the Window Net creates an effective barrier across the entire width of an open window.

The enclosed illustrations should clarify the above.

Operation of Preferred Embodiment—FIGS. 2A, 2F

The Window Net Child Safety Device is an effective, cost efficient means of preventing children, objects, or pets from passing through an open window. The current invention is also easy to install, and can be removed quickly and easily, by a person over the age of 5, in an emergency. Furthermore, the window net can be installed on a greater variety of window frames than the prior art.

The four flanges are used to secure the subassemblies, and thus the window net, to the vertical sides of a double hung window frame. The preferred means of attachment is via four screws disposed through four screw holes in each flange. This procedure is illustrated in FIG. 2E.

After threading the upper subassembly through loop 54U and the lower subassembly through loop 54L, and attaching the subassemblies to the respective flanges, the subassemblies function as a means of support for retaining net 52.

As outlined earlier, the hitch pins are utilized to lock the subassemblies to their respective flanges. Likewise, the pins are disposed through openings in the loop's net material, securing the retaining net across the window opening. Thus, an effective, comprehensive barrier is created. FIG. 2A, illustrates the pins, the net and the subassemblies installed in their final position in a double hung window.

Finally, while the hitch pins provide a means for securing the device to the window, they also allow the subassemblies to be released quickly from the flanges in an emergency. The pins are simply pulled upwards, completely removing them from their position inside their respective apertures. Once the pins are removed, the installation process can be quickly reversed; allowing the interior tubes to be retracted inside the exterior tubes. The subassemblies and the net can then be removed, providing access to the window opening. In practice, only the upper subassembly needs to be removed to obtain sufficient window access.

FIG. 2G—Alternative Embodiment: A Window Net Installed in a French Window

As seen in FIG. 2G, the window net 18 may be installed in a French window frame 68 by screwing the flanges into the exterior, vertical sides of the frame. Securing the window net in this manner allows a French window 70, or a window of similar hinged design, to be opened or closed without having to remove the apparatus. This is a distinct advantage over the prior art; many of which can not be mounted in a window of this type at all.

FIG. 3—Alternative Embodiment: A Window Net Installed Vertically in a Window Frame FIG. 3, illustrates the installation of the window net in window frame 66 where the nesting tube subassemblies run parallel to the vertical sides of the frame. Thus, the minor flange are attached to the bottom, horizontal edge of the window frame; the major flanges are secured to the top, horizontal edge of the frame.

A vertical retaining net 72 differs from retaining net 52 in that the alternate net would be of a much greater dimension, height and width, to provide sufficient coverage across the window opening. This alternative embodiment would provide even greater window protection, if necessary.

FIGS. 4 and 4A—Alternative Embodiment: A Custom Installed Window Net

FIG. 4, is an exploded view of a custom window net 74. The custom net is secured to the window frame via four 21 mm (1 inch) floor flanges, as opposed to the major and minor flanges used in the preferred embodiment. The floor flanges are labeled as flange 76A, flange 76B, flange 76C, and flange 76D.

The upper and lower nesting tube subassemblies are replaced by a pair of steel or aluminum pipes or conduits; labeled as upper pipe 77U and lower pipe 77L. The upper and lower pipes are adjusted to varying window size widths by cutting the lengths of the upper and lower tubes to match the window frame's width minus roughly 3 mm (⅛th inch.)

To install the upper pipe, one of end pipe 77U is disposed within a flange aperture 78A, and the opposing end is disposed within a flange aperture 78C. Flange 76A and flange 76C are then screwed to opposing vertical sides of the window frame such that pipe 77U is parallel to the horizontal sides of the frame, and perpendicular to the frame's vertical sides. The lower pipe is installed in the same manner: disposing each end of the lower pipe within a flange aperture 78B or flange aperture 78D; then securing flange 76B and flange 76D to opposing vertical sides of the window frame. The distance between the upper and lower pipes is such that the retaining net is held taunt across the window opening.

The custom window net utilizes the same retaining net 52 as the preferred embodiment, and is secured to the upper and lower pipes in the same manner. The net may be further secured in position by cinching the net material to the upper and/or lower pipes with conventional zip ties (not shown.) The perspective view of FIG. 4A clearly illustrates the custom installed window net secured to the window frame.

With the exception of the net, all of the parts can be readily purchased from a hardware or home improvement store at a minimal cost. Thus, the custom window net is an inexpensive means of effectively shielding an open window.

FIGS. 5 and 5A—Alternative Embodiment: Wall Mounted Window Net

As seen in the perspective view of FIG. 5, with a minor modification to the nesting tube subassemblies and the flanges, a wall mounted window net 80 can be manufactured to shield a window opening where a window frame 82 is of limited depth.

With the wall mounted window net, the minor and major flanges are replaced by a set of four alternate flanges, each referenced as flange 88A, flange 88B, flange 88C, and flange 88D. The alternate flanges are identical to each other in design and construction. As seen in FIG. 5A, the alternate flanges are the same as the flanges of the preferred embodiment, however, each alternate flange has an alternate flange knob which are longer; roughly 30 mm (1⅜ inch) in length. The alternate flange knobs are labeled as knob 90A, knob 90B, knob 90C, and knob 90D.

In this embodiment, the nesting tube subassemblies described previously are replaced by an alternate nesting subassembly 84U and alternate nesting subassembly 84L. Subassembly 84U has an aperture 86R at one end, and an identical aperture 86L at the opposing end. The diameter of each aperture is equal to the diameter of the alternate flange knobs. Subassembly 84L is identical in construction and design, having an aperture 87R and an aperture 87L at opposing ends.

As seen in FIG. 5, the alternate flanges are mounted on the wall such that the alternate knobs are perpendicular to the wall. The alternate flanges are screwed to the wall roughly 2 inches from the center of their respective knobs to the window opening. The alternate subassembly 84U is coupled to knob 90A and knob 90C by extending the subassembly axially across the window opening; then disposing knob 90A through aperture 86L (FIG. 5A) and disposing knob 90C through aperture 86R (FIG. 5A). Likewise, alternate subassembly 84L is attached to knob 90B and knob 90D by extending the subassembly axially; then disposing knob 90B through aperture 87L (FIG. 5A) and disposing knob 90D through aperture 87R (FIG. 5A). The subassemblies should be positioned flush against the flange backplates. Hitch pins are inserted into an alternate knob aperture 92A, alternate knob aperture 92B, alternate knob aperture 92C and alternate knob aperture 92D, securing the alternate subassemblies, and thus window net 79, to the wall.

The wall mounted window net provides an alternative means for attaching the retaining net to a window frame. The result is a window net which shields a window opening more effectively than the prior art; is more capable of being removed quickly in an emergency; is more efficient mechanically; yet, is able to be used on a much wider variety of window frames than any guards designed previously.

FIG. 6 and FIG. 6A—Alternative Embodiment: Alternate Loops for The Retaining Net As seen in the exploded view of FIG. 6, the upper and lower loops of the preferred embodiment may be replaced with an upper and a lower loop attachment, labeled as loop 94U and loop 94L respectively. The upper loop attachment is constructed of a piece of ballistic nylon roughly 6 inches in length and of a width equal to the width of the net material 58. The ballistic nylon is folded in half lengthwise, enveloping one inch along a top edge 96 of the net material. The ballistic nylon and net material are sewn together with a straight stitch 98. The stitch is roughly 5 mm (¼ inch) from the width edge of the upper loop attachment. The lower loop attachment is constructed and attached to a bottom edge 99 of the net material in an identical manner. The perspective view of FIG. 6A illustrates a completed alternate retaining net 100 with the loops firmly attached.

Conclusion, Ramifications and Scope of Invention

Therefore, the reader will see that the window net of the invention provides a highly effective, mechanically efficient means of preventing children, pets or objects from inadvertently passing through a window opening. Moreover, the window net is truly adjustable, providing complete coverage across the width of a window opening, regardless of the style or size of the window frame. The window net can also be removed quickly and easily at a time of peril, by a person older than 5 years of age.

While the above description lists a number of specificities, these should not be construed as limitations on the scope of the invention, but rather as an exemplification of one or more preferred embodiments thereof. Many additional variations are feasible. For example:

- The nesting subassemblies may be constructed of a variety of rigid plastics or types of metal. Further, subassemblies may consist of tubes which are square, triangular or alternatively shaped. The lengths and diameters of the tubes may also vary.
- The hitch pins may be replaced by other locking means such as locking cotter pins, hitch pin clips or the like.
- The retaining net can be manufactured from a variety of materials other than nylon netting, including, but not limited to, canvas, nylon or plastic, metal screen; or rubber netting.
- The retaining net may also be decorative in design, having various pictures, drawings, or motifs disposed thereon. The net may also be manufactured in a range of colors, in addition to black or white.
- The backplate and flange knobs may be machined or molded together as a single unit, i.e. a minor flange, or the two elements may be manufactured independently and joined together via screws or other means. Thus, the flanges can be manufactured integrally or modularly.

Accordingly, the scope of the invention should not be determined by the embodiments illustrated, but by the appended claims and their legal equivalents.

I claim:

1. A window net child safety guard comprising:

an upper pair of mounting flanges and a lower pair of mounting flanges each of which are identical to each other in design and construction and have a planar backplate having disposed thereon a cylindrical flange knob, said cylindrical flange knob including an aperture;

an upper interior nesting tube having first and second ends, defining a longitudinal axis, and including a first diameter;

an upper exterior nesting tube having first and second ends, defining a longitudinal axis, and including a second diameter greater than the first diameter of said upper interior nesting tube;

the first end of said upper interior nesting tube having an aperture transverse to the longitudinal axis and sized to receive therein said cylindrical flange knob and the second end of said upper interior nesting tube being slidably received within the first end of said upper exterior nesting tube, the second end of said upper exterior nesting tube having an aperture transverse to the longitudinal axis and sized to receive therein said cylindrical flange knob;

a lower interior nesting tube having first and second ends, defining a longitudinal axis, and including a first diameter;

a lower exterior nesting tube having first and second ends, defining a longitudinal axis, and including a second diameter greater than the first diameter of said lower interior nesting tube;

the first end of said lower interior nesting tube having an aperture transverse to the longitudinal axis and sized to receive therein said cylindrical flange knob and the second end of said lower interior nesting tube being slidably received within the first end of said lower exterior nesting tube, the second end of said lower exterior nesting tube having an aperture transverse to the longitudinal axis and sized to receive therein said cylindrical flange knob;

a retaining net having an upper loop and a lower loop, the upper loop receiving the upper interior and exterior nesting tubes and the lower loop receiving the lower interior and exterior nesting tubes;

each of said mounting flanges further having a hitch pin, wherein, the cylindrical flange knobs of said mounting flanges extend through the apertures of said nesting tubes such that the aperture of said cylindrical flange knobs extends therefrom and receive said hitch pin so as to secure said nesting tubes to said mounting flanges.

* * * * *